United States Patent [19]

Musselmann et al.

[11] Patent Number: 4,585,551

[45] Date of Patent: Apr. 29, 1986

[54] ROTOR FOR SORTING APPARATUS FOR CLEANING FIBROUS SUSPENSIONS

[75] Inventors: Walter Musselmann; Juan Valdiva, both of Heidenheim, Fed. Rep. of Germany

[73] Assignee: J. M. Voith GmbH, Heidenheim, Fed. Rep. of Germany

[21] Appl. No.: 493,023

[22] Filed: May 9, 1983

[30] Foreign Application Priority Data

May 12, 1982 [DE] Fed. Rep. of Germany ..... 3217824

[51] Int. Cl.[4] ..... B07B 1/50

[52] U.S. Cl. ..... 209/379; 209/273; 210/415

[58] Field of Search ..... 209/379, 270, 273, 363; 210/433.1, 397, 413, 415

[56] References Cited

U.S. PATENT DOCUMENTS

| | | | |
|---|---|---|---|
| 2,983,379 | 5/1961 | Cram | 209/273 |
| 3,126,818 | 3/1964 | Koelsch | 210/415 |
| 3,235,087 | 2/1966 | Andrews et al. | 210/415 |
| 3,247,965 | 4/1966 | Braun et al. | 209/270 |
| 3,547,267 | 12/1970 | Sutherland | 209/379 |
| 3,739,915 | 6/1973 | Kehoe et al. | 210/415 |
| 4,213,823 | 7/1980 | Wittig et al. | 209/273 |
| 4,238,324 | 12/1980 | Musselmann et al. | 209/261 |

*Primary Examiner*—Frank W. Lutter
*Assistant Examiner*—William Bond
*Attorney, Agent, or Firm*—Louis H. Reens

[57] ABSTRACT

A rotor for a sorting apparatus for cleaning fibrous suspensions such as produced from the making of paper is described. The rotor is equipped with sorter blades which extend substantially parallel to the axis of rotation and are set at a desired angle relative to the direction of rotation of the rotor so as to create a hydrofoil effect. The sorter blades are mounted to one or more supporting walls shaped in a spiral form to provide spiral surfaces which are coaxial with the axis of rotation of the rotor and impart a conveying motion to the fibrous suspension. Upon rotation of the rotor in a fibrous suspension entanglements by impurities are avoided and the danger of the occurrence of a blockage of the strainer used in the sorter apparatus is reduced.

10 Claims, 4 Drawing Figures

ROTOR FOR SORTING APPARATUS FOR CLEANING FIBROUS SUSPENSIONS

Figure 1:
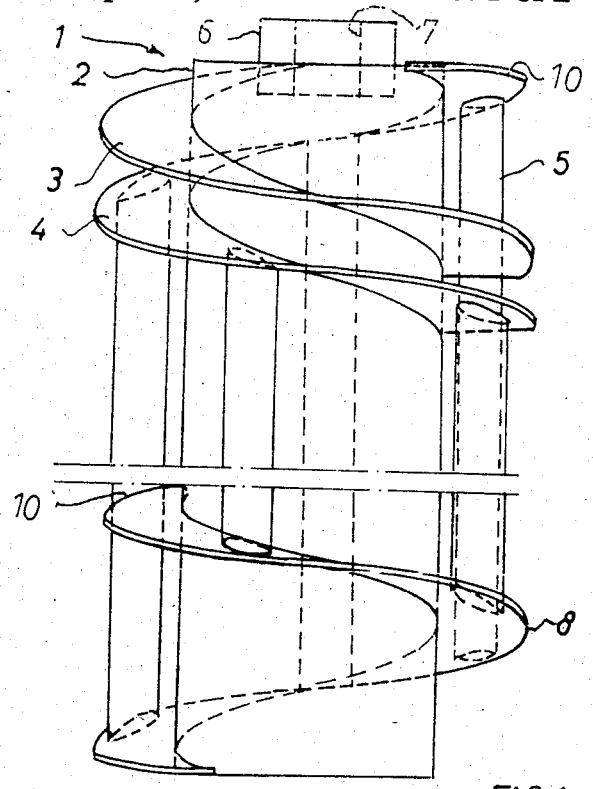

This invention generally relates to a rotor for a sorting apparatus used to clean fibrous suspensions and more specifically to a rotor for sorting apparatus used in the paper making industry.

Sorting apparatus for fibrous suspensions are known; see, for example, U.S. Pat. No. 2,835,173. In such sorting apparatus the pulsations that are produced enable the rotor sorter blades, which are constructed with a hydrofoil-like profile that extends substantially parallel to the axis of rotation of the rotor, to effectively eliminate or reduce to an insignificant level the danger of blocking of the holes or perforations in the strainer basket used in the sorting apparatus by impurities, fibers or flecks which are not small enough to pass through the strainer. The arms used to support the sorter blades cause a considerable obstruction to the flow of the fibrous suspension in the housing of the sorting apparatus and consequently also hinder the separating effect of the strainer basket in such apparatus. Web like materials may become entangled with or be deposited on or attach to these supporting arms, causing a disruption of the sorting process.

In order to counteract such blocking, British Pat. No. 1,081,546 teaches use of sorter blades held in position by supporting arms which have rounded profiles at least at the front side facing the direction of flow of the suspension.

In British Pat. No. 336,252 a sorting apparatus is described for the purification of flour with a rotor formed with a cylinder whose lower part bears conveying ribs or bars which are spirals while in the upper part of the cylinder the bars are discontinuous spiral-like. This apparatus operates according to an entirely different principle, attributable to its preferred use for sorting or purifying flour and because there is no disclosure of the use of sorter bars with a foil-like profile to keep the strainer basket clear and neither the problem of web entanglement nor the solution of such problem are described.

It is an object of the present invention to provide a rotor for a sorting apparatus wherein an unobstructed flow can be achieved through the strainer space formed between the sorter blades without any entanglements.

This object is achieved in a rotor of this invention with a supporting wall that is shaped in the form of a spiral so as to provide a spiral surface which is coaxial with the rotor axis of rotation to impart movement to the fibrous suspension along the axis and wherein sorter blades are mounted to the supporting wall with a desired orientation relative to the direction of rotation of the rotor to produce a hydrofoil-like effect.

With a rotor of this invention entanglements with impurities from the fibrous suspension are substantially eliminated so that a trouble-free performance by the sorting apparatus is possible, even when the soil content is at a high level.

A further advantage of the rotor of this invention is the possibility of operating the sorting machine centrifugally or centripetally by rotation of the sorter blades and by changing the direction of rotation.

These and other advantages and objects of the invention can be understood from the following description of several embodiments which are described in conjunction with the drawings.

Figure 2:
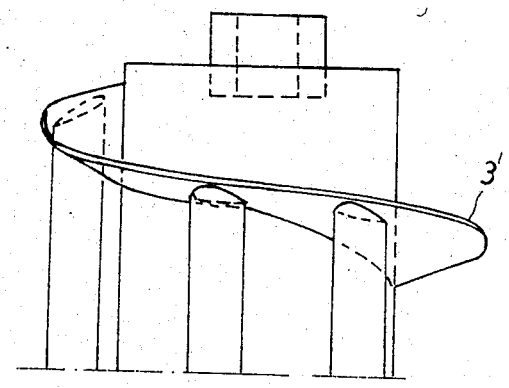
Figure 3:
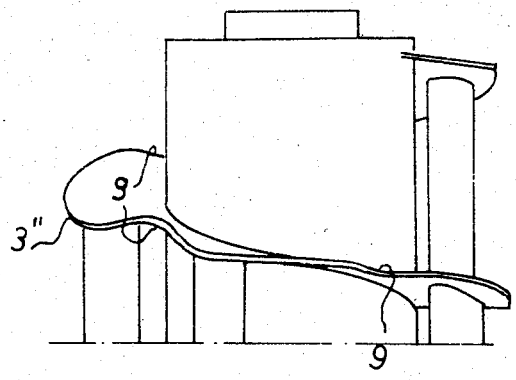
Figure 4:
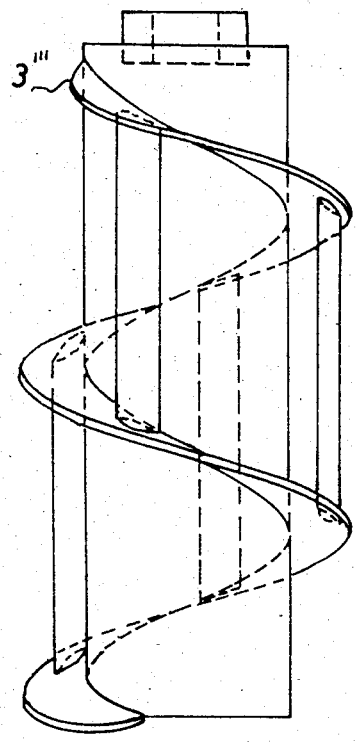

FIG. 1 is a front view in elevation of a rtor according to the invention, and FIGS. 2, 3 and 4 are front elevation views of othe rotor versions according to the invention.

With reference to FIG. 1 rotor 1 is shown formed with a cylinder 2 which at least at one end has an extension 6 with a central inner bore 7 for mounting cylinder 2. At its upper end cylinder 2 has two spirally shaped supporting walls 3 and 4 while the lower end of cylinder 2 has one spiral supporting wall 8. Spiral supporting walls 3, 4 and 8 are connected to sorter blades 5 which have a hydrofoil-like profile. The radially outer edges 10, which are located at the front of the spiral supporting walls 3, 4 and 8 are viewed in the direction of rotation, are rounded, so that these edges do not form attachment points where tangling impurities can deposit and accumulate. With completely smooth spiral surfaces of the supporting walls 3, 4 and 8 there are no longer any attachment points for tangling impurities.

The spiral surfaces of the support walls impart a motion to the fibrous suspension so as to convey it, for example, from the upper end of cylinder 2 through the strainer space formed between the outer surface of cylinder 2 and the radially outer edge of the spiral surfaces of walls 3, 4 and 8. This radially outer edge should also be considered to define the radially outermost part of a strainer basket. It is, therefore, no longer essential that sorter blades 5 should be arranged in a special manner such as with an inward sloping, to generate a conveying motion to the suspension that moves it through the strainer space. The spiral supporting wall 8 at the end of the strainer may be arranged, for example, to continually convey the suspension fraction, which is loaded with waste, out of the strainer space.

The pulp stock is strained through the strainer basket by the sorter blades 5, the crossectional hydrofoil-like blade construction of which causes a pulsating pressure at the strainer basket to keep the latter free from blockage. Consequently, with a rotor construction according to this invention the best possible throughput of fibrous suspension through the straining appliance is ensured without a danger of obstructional blockage by material in the suspension.

FIG. 2 shows the spiral surfaces of a supporting wall 3' not exactly perpendicular to the axis of rotation of the rotor as in FIG. 1, but an an inclination thereto within a certain angular range that is at a small acute angle relative to radial planes that are transverse to the axis. This enables the spiral supporting wall 3' to impart a fluid motion with directional components towards the strainer basket as well as radially outward.

FIG. 3 shows a spiral supporting wall 3'' which has recesses 9 extending radially inwardly. These recesses enable a faster throughput of the suspension through the strainer space, particularly in a pressure-sorting operation of the sorting apparatus.

In the embodiment shown in FIG. 4 a single continuous spiral supporting wall 3''' is shown to extend over the whole axial length of the cylinder 2 to support sorter blades 5. In this instance, relatively shorter sorter blades 5 can be used between axially successive patches of a spiral supporting wall 3''' as well as arranged so as to be circumferentially off-set from each other as shown in FIG. 4.

In an alternate form, sorter blades 5 can be attached to the outer circumference (or edge 10) of the supporting walls, e.g. by welding, so that the lengths of blades 5 can be selected independently from the pitch of the spiral supporting walls.

It is advantageous, as shown in the Figures, to provide supporting walls 3 to support sorter blades 5 at both ends of the cylinder 2. Provision can then be made to select the orientation of the sorter blades relative to the circumferential direction. This can be done with pins and screws that fix this orientation in a manner that, if required, enables an angular change in the orientation of the hydrofoil-like blades. It is even possible to alter the orientation of the sorter blades so as to convert a positive orientation causing high pressure pulsations to a negative orientation which generates low pressure pulsations.

The diameter of the cylinder 2 can be reduced to such an extent as to, in effect, vanish leaving the spiral supporting wall as a conveying screw in the center to support the sorter blades either over the whole length of the strainer basket of the sorter apparatus or, only at axial rotor ends that are connected to sorter blades. In such case the rotor is appropriately mounted with at least one or several extensions 6, as shown in FIG. 1.

Having thus described the invention in various forms thereof, its advantages can be appreciated. Variations can be made without departing from the scope of the invention as determined by the following claims.

What is claimed is:

1. A rotor for a sorting apparatus used to clean fibrous suspensions such as fibrous suspensions produced in paper making wherein the rotor is mounted to rotate about an axis and has sorter blades extending substantially parallel to the axis of rotation comprising:

a central supporting cylinder, a supporting wall formed on said cylinder and shaped to provide a spiral surface which is coaxial with the rotor axis of rotation to impart movement of the fibrous suspension along the axis and sorter blades mounted to said supporting wall with a desired orientation relative to the direction of rotation of the rotor so as to create a hydrofoil-like effect.

2. The rotor as claimed in claim 1 wherein the central supporting cylinder is aligned parallel with said axis with said supporting wall being mounted in the vicinity of one of the axial ends of the cylinder.

3. The rotor as claimed in claim 2 wherein the supporting wall extends in a spiral over a considerable part of the whole length of the cylinder.

4. The rotor as claimed in claim 3 wherein a plurality of sorter blades are mounted to and between successive pitches of the supporting wall with the sorter blades being circumferentially off-set from each other.

5. The rotor as claimed in claim 2 wherein a said spiral shaped supporting wall is mounted at each axial end of the cylinder.

6. The rotor as claimed in claim 2 wherein each supporting wall has radially inwardly extending recesses at regular intervals along the perimeter of the support wall.

7. The rotor as claimed in claim 2 and further comprising a second spiral-shaped supporting wall spaced adjacent and parallel to the first supporting wall.

8. The rotor as claimed in claim 2 wherein the spiral of the supporting wall is inclined to form a small acute angle relative to the rotational axis.

9. The rotor as claimed in claim 1 wherein the sorter blades are adjustably attached to the supporting wall so as to be placed in a desired orientation relative to the direction of rotation of the rotor.

10. The rotor as claimed in claim 1 wherein the sorter blades are so mounted to the supporting wall that the radially outer parts of the profiles of the sorter blades terminate substantially flush with the radially outer boundary surface of the supporting wall.

* * * * *